US008727807B2

(12) United States Patent
Sykes et al.

(10) Patent No.: US 8,727,807 B2
(45) Date of Patent: May 20, 2014

(54) COAXIAL CONNECTOR

(75) Inventors: Michael Timothy Sykes, Mechanicsburg, PA (US); Mattia Scheggia, Como (IT); Keith Richard Foltz, Duncannon, PA (US); Michael J. Block, Carlisle, PA (US); Kevin E. Weidner, Hummelstown, PA (US); Jeffrey K. Orner, Boiling Springs, PA (US); Tim R. Chevalier, Cleona, PA (US)

(73) Assignees: Tyco Electronics Corporation, Berwyn, PA (US); Tyco Electronics Logistics AG, Steinach (CH)

( * ) Notice: Subject to any disclaimer, the term of this patent is extended or adjusted under 35 U.S.C. 154(b) by 145 days.

(21) Appl. No.: 13/284,553

(22) Filed: Oct. 28, 2011

(65) Prior Publication Data

US 2013/0109231 A1 May 2, 2013

(51) Int. Cl.
*H01R 9/05* (2006.01)
*H01R 24/44* (2011.01)

(52) U.S. Cl.
CPC ..... *H01R 24/44* (2013.01)
USPC ..... 439/578; 439/63

(58) Field of Classification Search
USPC ..... 439/585, 581, 578, 63
See application file for complete search history.

(56) References Cited

U.S. PATENT DOCUMENTS

| | | | | | |
|---|---|---|---|---|---|
| 4,010,538 | A * | 3/1977 | O'Keefe et al. | 29/865 |
| 4,453,796 | A | 6/1984 | Monroe | |
| 4,650,271 | A | 3/1987 | Forney, Jr. et al. | |
| 4,718,864 | A | 1/1988 | Flanagan | |
| 5,037,328 | A * | 8/1991 | Karlovich | 439/578 |
| 5,269,702 | A * | 12/1993 | Bacher et al. | 439/578 |
| 5,467,062 | A * | 11/1995 | Burroughs | 333/124 |
| 5,730,622 | A * | 3/1998 | Olson | 439/578 |
| 6,551,136 | B2 * | 4/2003 | Johnsen et al. | 439/578 |
| 6,602,093 | B1 | 8/2003 | Cannon | |
| 7,934,954 | B1 * | 5/2011 | Chawgo et al. | 439/578 |
| 8,241,060 | B2 * | 8/2012 | Sykes | 439/578 |
| 2008/0207051 | A1 | 8/2008 | Montena | |
| 2008/0311788 | A1 | 12/2008 | Vaccaro | |
| 2008/0318470 | A1 | 12/2008 | Morikawa | |
| 2010/0124838 | A1 | 5/2010 | Montena et al. | |
| 2011/0130034 | A1 * | 6/2011 | Montena et al. | 439/578 |
| 2011/0263154 | A1 | 10/2011 | Chawgo et al. | |

OTHER PUBLICATIONS

European Search Report, European Application No. 12190259,7, European Filing Date Oct. 26, 2012.

* cited by examiner

*Primary Examiner* — Tho D Ta
*Assistant Examiner* — Travis Chambers

(57) ABSTRACT

A coaxial connector includes a center contact, an outer contact and a dielectric insert received in the outer contact and holding the center contact. The dielectric insert may have structural features that extend axially along an exterior of the dielectric insert with air gaps between the structural features. The outer contact may include a rear housing that is interchangeably coupled to either a plug housing or a jack housing at the housing interface. The center contact may be configured to be terminated by a plurality of different termination techniques in different applications.

19 Claims, 8 Drawing Sheets

COAXIAL CONNECTOR

CROSS REFERENCE TO RELATED APPLICATIONS

This application claims the benefit of U.S. patent application Ser. No. 13/284,577 and titled COAXIAL CONNECTOR filed on the same day; claims the benefit of U.S. Design patent application Ser. No. 29/405,151 and titled COAXIAL CONNECTOR filed on the same day; claims the benefit of U.S. Design patent application Ser. No. 29/405,154 and titled COAXIAL CONNECTOR filed on the same day, the subject matter of each of which are herein incorporated by reference in their entirety.

BACKGROUND OF THE INVENTION

The subject matter herein relates generally to coaxial connectors.

A typical coaxial connector has a metal outer shell, an inner dielectric insert, and a center contact to carry the signal which is secured within the inner dielectric insert. Coaxial connectors may be either plug connectors or jack connectors of either standard or reverse polarity configurations. Coaxial connectors may be either terminated to cable or terminated to a printed circuit board (PCB). For cable-mounted applications, the outer metal shell is crimped or soldered to the outer metal braid or solid metal jacket of the coaxial cable to provide an electrical connection between the shielding of the cable and the connector, while the center contact is crimped to the central conductor of the coaxial cable to provide connection for the signal pathway. For board-mounted applications, the outer metal shell is mechanically and electrically connected to a ground conductor of the PCB, while the center contact is mechanically and electrically connected to a signal conductor of the PCB.

Typical coaxial connectors are not without disadvantages. For instance, typical coaxial connectors on the market are not platform designs, and do not enable customization or automated manufacturing. For example, the plug connectors are manufactured from multiple pieces or components specific to the plug connector design and the jack connectors are manufactured from multiple pieces or components specific to the jack connector design. Additionally, the cable-mounted connectors are manufactured from multiple pieces or components specific to the cable mounting design and the board-mounted connectors are manufactured from multiple pieces or components specific to the board mounting design. Moreover, the coaxial connectors are typically assembled by hand, which is time consuming. The pieces and components of the coaxial connectors are typically screw machined.

A need remains for a coaxial connector platform that allows for product design extensions, automated manufacturing and/or low cost.

BRIEF DESCRIPTION OF THE INVENTION

In one embodiment, a coaxial connector is provided having a center contact and an outer contact having a central cavity. The center contact is disposed in the central cavity. The outer contact has a separable interface end configured to be mated to a mating connector and a non-separable terminating end. The cavity extends between the separable interface end and the terminating end. A dielectric insert is received in the central cavity. The dielectric insert has a bore that receives and holds the center contact. The dielectric insert has structural features that may extend axially, or in alternative forms, along an exterior of the dielectric insert. Air gaps may be defined between the structural features to create an effective dielectric constant to achieve a desired characteristic impedance. The structural features engage the outer contact to secure the dielectric insert in the central cavity.

In another embodiment, a coaxial connector is provided having a center contact and a dielectric insert having a bore that receives and holds the center contact. The coaxial connector also includes an outer contact having a central cavity that receives the dielectric insert and center contact. The outer contact has a separable interface end configured to be mated to a mating connector. The outer contact has a non-separable terminating end configured to be terminated to a coaxial cable. The outer contact includes a rear housing that defines the terminating end. The rear housing has a housing interface at a front of the rear housing. The rear housing is interchangeably coupled to either a plug housing or a jack housing at the housing interface. When the plug housing is coupled to the rear housing, the outer contact includes a coupling nut component which is placed onto and rotatably coupled to the plug housing. The coupling nut includes internal threads for coupling the outer contact to a jack connector that defines the mating connector. When the jack housing is coupled to the rear housing, the outer contact includes external threads for coupling the outer contact to a plug connector that defines the mating connector.

In a further embodiment, a coaxial connector is provided having an outer contact that has a central cavity. The outer contact has a separable interface end configured to be mated to a mating connector and a non-separable terminating end. The cavity extends between the separable interface end and the terminating end. A dielectric insert is secured in the central cavity. The dielectric insert has a bore therethrough. A center contact is held in the bore of the dielectric insert. The center contact has a separable interface end and a terminating end with a barrel at the terminating end. In a first termination application, the terminating end is configured to receive a center conductor in the barrel and be crimped to the center conductor. In a second termination application, the terminating end is configured to receive a center conductor in the barrel and be soldered to the center conductor.

DETAILED DESCRIPTION OF THE INVENTION

Figure 1:
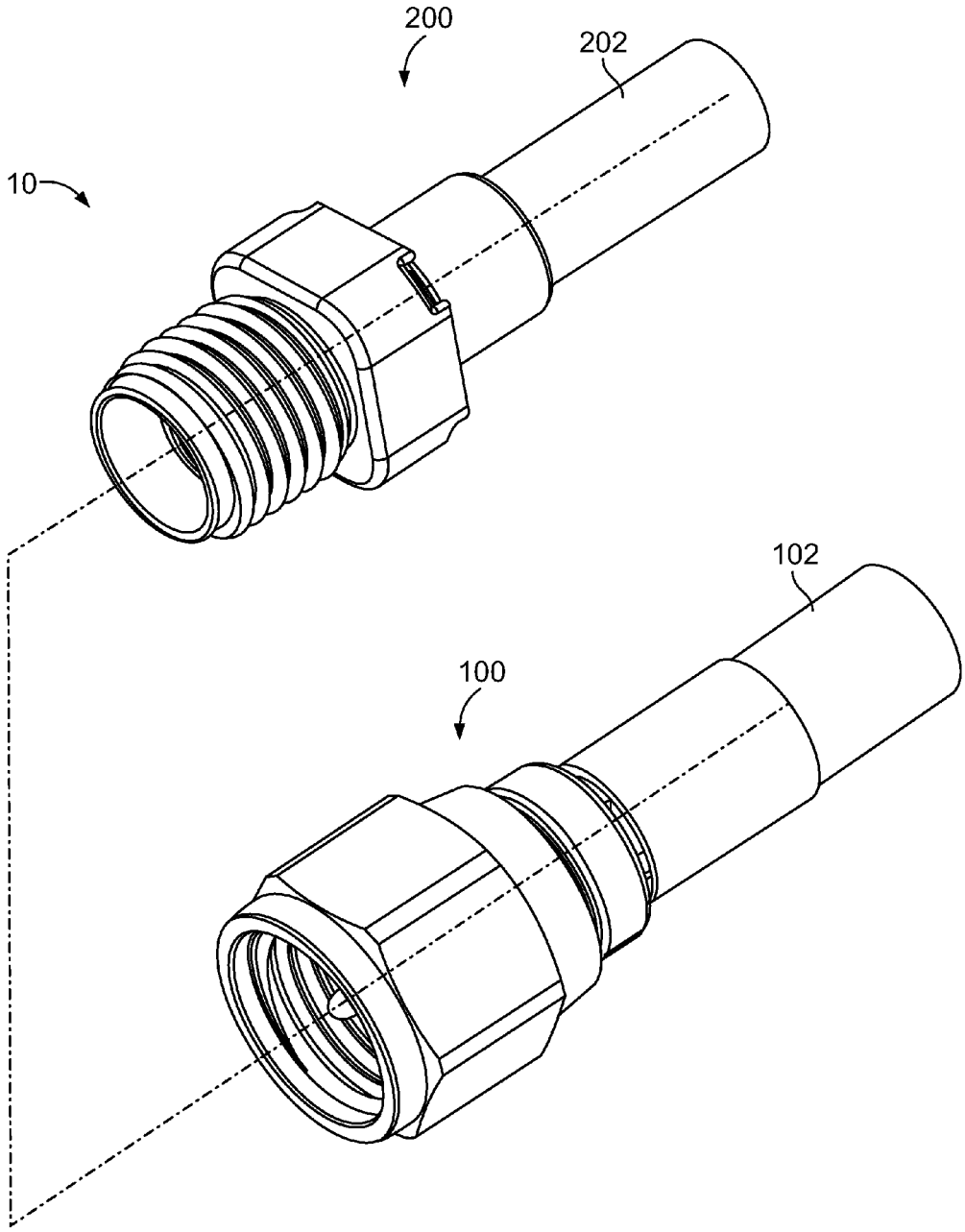
FIG. 1 illustrates a coaxial connector system formed in accordance with an exemplary embodiment.

FIG. 1 illustrates a coaxial connector system 10 formed in accordance with an exemplary embodiment. The coaxial connector system 10 includes a plug connector 100 that is configured to be connected to a jack connector 200. The plug connector 100 may be connected to the board mounted jack connector 300 (shown in FIG. 9) in an alternative embodiment. The plug connector 100 is terminated to a coaxial cable 102 and the jack connector 200 is terminated to a coaxial cable 202.

In an exemplary embodiment, the plug connector 100 is threadably coupled to the jack connector 200 using internal threads on the plug connector 100 and external threads on the jack connector 200. Alternative coupling means may be used in alternative embodiments to secure the plug connector 100 to the jack connector 200.

Figure 2:
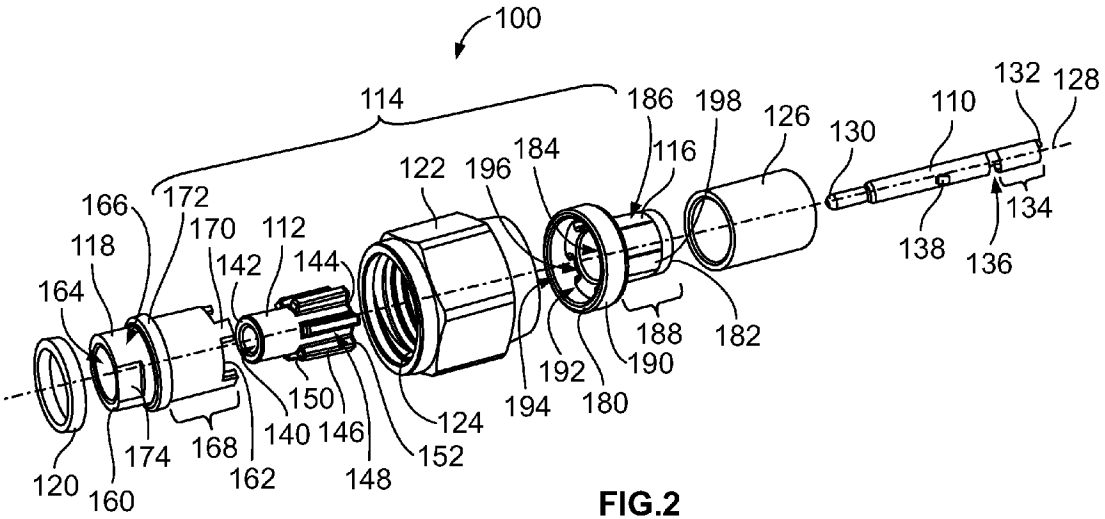
FIG. 2 is an exploded view of a plug connector of the coaxial connector system shown in FIG. 1.

FIG. 2 is an exploded view of the plug connector 100. The plug connector 100 includes a center contact 110, a dielectric insert 112 that holds the center contact 110 and an outer contact 114 that receives the dielectric insert 112 and the center contact 110. The center contact 110 is configured to be terminated to a center conductor (not shown) of the coaxial cable 102 (shown in FIG. 1). The outer contact 114 is configured to be electrically connected to an outer conductor or cable shield (not shown) of the coaxial cable 102, such as by crimping or soldering to the cable shield.

In an exemplary embodiment, the outer contact 114 is a two-piece body formed from a rear housing 116 and a front housing 118. In the illustrated embodiment, the front housing 118 defines a plug housing and may be referred to hereinafter as the plug housing 118.

The plug connector 100 includes a gasket 120 coupled to the plug housing 118 to seal against the jack connector 200 (shown in FIG. 1) when mated thereto. The plug connector 100 includes a coupling nut 122 that is configured to be rotatably coupled to the plug housing 118. The coupling nut 122 has internal threads 124 for securing the plug connector 100 to the jack connector 200.

The plug connector 100 includes a crimp barrel 126 coupled to the rear housing 116. The crimp barrel 126 is used to crimp the plug connector 100 to the coaxial cable 102. The crimp barrel 126 is used to mechanically and electrically connect the plug connector 100 to the coaxial cable 102.

The center contact 110 extends along a longitudinal axis 128 of the plug connector 100 between a separable interface end 130 and a non-separable terminating end 132. The separable interface end 130 is configured to be mated with a corresponding contact of the jack connector 200 when the plug connector 100 is coupled thereto. Optionally, the center contact 110 may be selectively plated at the separable interface end 130 to enhance the performance and/or conductivity of the separable interface. In the illustrated embodiment, the separable interface end 130 defines a pin, however the center contact 110 may have a different mating interface in an alternative embodiment, such as a socket, such as to define a reverse polarity connector. In an exemplary embodiment, the center contact 110 is a stamped and formed contact. Stamped and formed contacts are less expensive to manufacture than machined contacts.

The terminating end 132 is configured to be terminated to a center conductor of the coaxial cable 102. In an exemplary embodiment, the center contact 110 has a barrel 134 at the terminating end 132. The barrel 134 is configured to receive the center conductor of the coaxial cable 102 therein. In an exemplary embodiment, the center contact 110 may be terminated to the center conductor of the coaxial cable 102 in multiple ways. For example, the terminating end 132 may be crimped to the center conductor in a first termination application and may be soldered to the center conductor in a second termination application. Other types of terminations to the center conductor are possible in alternative embodiments, such as indenting, lancing, active beam termination, insulation displacement connection, and the like. By allowing the center contact 110 to be terminated to the center conductor in more than one manner, the same center contact 110 can be used for different applications and by different customers who prefer termination by either crimping or soldering. As such, the product family does not need to include different types of center contacts for different types of termination, thereby reducing the overall number parts for the product family and reducing the overall cost of the platform. Optionally, the barrel 134 may be selectively plated to facilitate soldering at the terminating end 132.

In an exemplary embodiment, the center contact 110 includes an opening 136 forward of the barrel 134. The opening 136 stops the crimp effect of the barrel 134 forward of the opening 136 leaving the remaining portion of the center contact 110 forward of the opening 136 unaffected by the crimping process. The opening 136 defines an orientation feature of the center contact 110 that allows the center contact 110 to be held at a particular orientation with respect to a machine used to assemble the plug connector 100. The opening 136 allows for automation of the assembly process of the plug connector 100 by allowing the center contact 110 to be held by a machine and inserted into the dielectric insert 112.

The center contact 110 includes locking tabs 138 extending therefrom. The locking tabs 138 are deflectable. The locking tabs 138 are used to secure the center contact 110 in the dielectric insert 112.

The dielectric insert 112 is manufactured from a dielectric material, such as a plastic material. The dielectric material may be a composite material. The dielectric insert 112 has a bore 140 extending therethrough that receives and holds the center contact 110. The dielectric insert 112 extends between a front 142 and a rear 144. The bore 140 extends entirely through the dielectric insert 112 between the front 142 and the rear 144. The bore 140 extends axially along the longitudinal axis 128 of the plug connector 100.

The dielectric insert 112 is generally tubular in shape and includes a plurality of structural features 146, such as wings or tabs, extending radially outward from an exterior of the tubular dielectric insert 112. In an exemplary embodiment, the structural features 146 extend axially along an exterior of the dielectric insert 112. Having the structural features 146 extend axially allows the dielectric insert 112 to be molded rather screw machined, which may be a less expensive manufacturing of the dielectric insert 112. Air gaps 148 are defined between the structural features 146 and introduce air (another type of dielectric) in the isolation area around the center contact 110. In the illustrated embodiment, the structural features 146 extend only partially along the dielectric insert 112. Optionally, the structural features 146 may extend along approximately half the axial length of the dielectric insert 112. The structural features 146 may extend any axial distance along the dielectric insert 112 in alternative embodiments. In the illustrated embodiment, the structural features 146 are located proximate to the rear 144, however the structural features 146 may be located at any axial position along the dielectric insert 112.

The structural features 146 are used to secure the dielectric insert 112 within the outer contact 114. In an exemplary embodiment, the dielectric insert 112 is received within the plug housing 118 and the structural features 146 engage the plug housing 118 to secure the dielectric insert 112 in the plug housing 118. The structural features 146 may engage the outer contact 114 and hold the dielectric insert 112 by an interference fit therein. In an exemplary embodiment, the structural features 146 are tapered from a front 150 to a rear 152 of the structural features 146 to increase the diameter of the dielectric insert 112 at the rear 144. As the dielectric insert 112 is loaded into the plug housing 118, the structural features 146 begin to engage the plug housing 118 and create a tighter fit between the dielectric insert 112 and the plug housing 118 as the dielectric insert 112 is further loaded into the plug housing 118.

In an exemplary embodiment, the size and shape of the structural features 146 are selected to provide a desired dielectric constant of the dielectric between the center contact 110 and the outer contact 114. When the center contact 110 and dielectric insert 112 are loaded into the outer contact 114, the center contact 110 is electrically isolated from the outer contact 114 by the material of the dielectric insert 112 and by air. The air and the dielectric insert 112 constitute the dielectric between the center contact 110 and the outer contact 114. The dielectric constant is affected by the amount of material of the dielectric insert 112 as well as the amount of air. The material of the dielectric insert 112 has a dielectric constant that is greater than the dielectric constant of air. By selecting the size and shape of the dielectric insert 112, including the structural features 146, the impedance of the plug connector 100 may be tuned, such as to achieve an impedance of 50 Ohms or another target impedance. For example, a design having more plastic in the isolation area between the outer contact 114 and the center contact 114 (e.g., a thicker tube, wider structural features 146, more structural features 146, longer structural features 146, and the like) may decrease the impedance, whereas providing more air may increase the impedance.

The plug housing 118 extends between a front 160 and a rear 162. The plug housing 118 has a central cavity 164 extending between the front 160 and the rear 162. The central cavity 164 receives the dielectric insert 112 and center contact 110. In an exemplary embodiment, the front 160 of the plug housing 118 defines a separable interface end 166 of the outer contact 114. The rear 162 of the plug housing 118 is configured to be coupled to the rear housing 116.

The plug housing 118 includes a barrel 168 at the rear 162. A plurality of posts 170 extend rearward from the barrel 168. As described in further detail below, the posts 170 are configured to be staked to the rear housing 116 to secure the plug housing 118 to the rear housing 116. For example, a special tool may be used to push down on the posts 170 to deform the posts 170. The tool has a special shape to deform the posts and to force portions of the posts over the end of the rear housing 116 thereby securing the plug housing 118 to the rear housing 116. The plug housing 118 may be coupled to the rear housing 116 by other means or processes in alternative embodiments.

The plug housing 118 includes a flange 172 extending from an exterior of the plug housing 118. The flange 172 extends circumferentially around the plug housing 118. The flange 172 is positioned forward of the barrel 168. The flange 172 is used to secure the coupling nut 122 to the plug housing 118.

The plug housing 118 includes flat surfaces 174 on an exterior thereof. The flat surfaces 174 are configured to angularly orient the plug housing 118 with respect to the rear housing 116 during coupling of the plug housing 118 to the rear housing 116. For example, the posts 170 may be oriented at a particular angular orientation with respect to the rear housing 116 during assembly. The flat surfaces 174 may be engaged by a machine used to assemble the plug connector 100 to hold the angular position of the plug housing 118 for loading the plug housing 118 into the rear housing 116. Other features may be provided in alternative embodiments that allow the plug housing 118 to be oriented with respect to the assembly machine for assembly of the plug connector 100.

The rear housing 116 is configured to be interchangeably coupled to either the plug housing 118, as in the illustrated embodiment, or the jack housing 218 (shown in FIG. 6) because the rear housing 116 includes features that allow either the jack housing 218 or the plug housing 118 to be coupled thereto. Additionally, the jack housing 218 and the plug housing 118 include similar features for mounting to the rear housing 116 such that the rear housing 116 may be used with either the jack housing 218 or the plug housing 118.

The rear housing 116 includes a front 180 and a rear 182. A central cavity 184 extends through the rear housing 116 between the front 180 and the rear 182. The rear 182 of the rear housing 116 defines a terminating end 186 of the outer contact 114. The rear housing 116 includes a tubular crimp end 188 proximate to the rear 182.

The rear housing 116 includes a rim 190 proximate to the front 180. The rim 190 extends forward from the crimp end 188. The rim 190 defines a chamber 192 that receives the plug housing 118. The rim 190 and chamber 192 define a housing interface 194 at the front 180 of the rear housing 116. The plug housing 118 is coupled to the housing interface 194.

In an exemplary embodiment, the rear housing 116 includes a plurality of openings 196 at a rear or bottom of the chamber 192. When the plug housing 118 is coupled to the rear housing 116, the barrel 168 of the plug housing 118 is received in the chamber 192 and the posts 170 of the plug housing 118 extend through corresponding openings 196 in the rear housing 116. The posts 170 extend entirely through the openings 196 and may be staked from behind the rim 190 to secure the plug housing 118 to the rear housing 116.

In an exemplary embodiment, the rear housing 116 includes a plurality of crush ribs 198 extending axially along an exterior of the crimp end 188. The crimp barrel 126 is configured to be plugged onto the crimp end 188 and held on the crimp end 188 by an interference fit with the crush ribs 198. The interference fit may be effected with or without crimping the crimp barrel 126 to the crimp end 188. The crimp barrel 126 is electrically and mechanically coupled to the crimp end 188 via the crush ribs 198. The crimp barrel 126 may be secured to the crimp end 188 by alternative means or processes in alternative embodiments, such as by soldering the crimp barrel 126 to the crimp end 188. The crimp end 188 may not include crush ribs in alternative embodiments.

Figure 3:
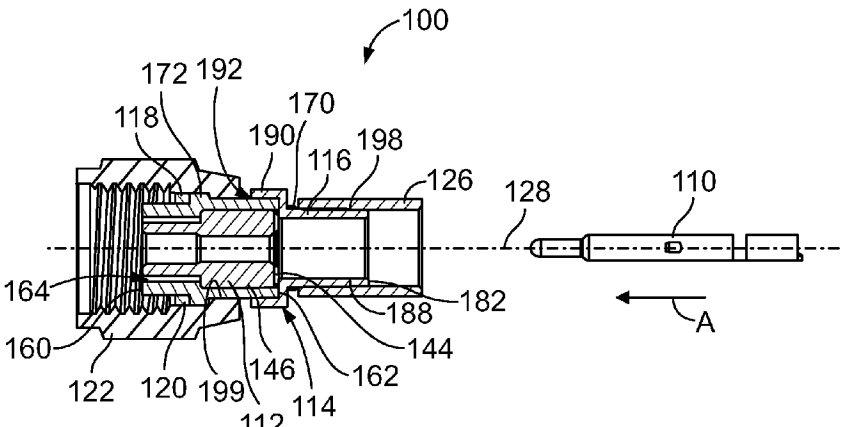
FIG. 3 is a cross-sectional view of the plug connector shown in FIG. 2.

FIG. 3 is a cross-sectional view of the plug connector 100 showing the center contact 110 poised for loading into the dielectric insert 112 and outer contact 114. During assembly, the gasket 120 is loaded onto the front 160 of the plug housing 118. The gasket 120 is seated against the flange 172. The coupling nut 122 is loaded onto the rear 162 of the plug housing 118. The coupling nut 122 extends forward of the front 160 of the plug housing 118. The coupling nut 122 defines a chamber that receives a portion of the jack connector 200 (shown in FIG. 1). The coupling nut 122 includes a lip 199 that engages the flange 172 to stop forward loading of the coupling nut 122 onto to the plug housing 118. The lip 199 is captured between the flange 172 and the rim 190 of the rear housing 116 to axially position the coupling nut 122 with respect to the plug housing 118. The coupling nut 122 is rotatable with respect to the plug housing 118. The flange 172 limits forward movement of the coupling nut 122 and the rim 190 limits rearward movement of the coupling nut 122.

The dielectric insert 112 is inserted into the plug housing 118 through the rear 162. The structural features 146 engage the plug housing 118 to hold the dielectric insert 112 in the central cavity 164 by an interference fit. In an exemplary embodiment, the rear 144 of the dielectric insert 112 is positioned forward of the rear 162 of the plug housing 118. The plug housing 118 is coupled to the rear housing 116 such that the rear 162 engages the wall defining the bottom of the chamber 192. The rear 162 of the plug housing 118 is received in the chamber 192. The rim 190 circumferentially surrounds the rear 162 of the plug housing 118. The wall at the rear or bottom of the chamber 192 is positioned behind the dielectric insert 112 to ensure that the dielectric insert 112 remains in position in the plug housing 118. The posts 170 (only portions of which can be seen in FIG. 3) extend through the rear housing 116 and are staked behind the rim 190.

The crimp barrel 126 is loaded onto the rear 182 of the rear housing 116 over the crimp end 188. The crush ribs 198 engage the crimp barrel 126 to hold the crimp barrel 126 on the crimp end 188. A portion of the crimp barrel 126 extends rearward from the crimp end 188 and is configured to be crimped to the coaxial cable 102 (shown in FIG. 1).

The center contact 110 is loaded along the longitudinal axis 128 in a loading direction, shown by the arrow A. The center contact 110 may be loaded into the dielectric insert 112 at any stage of the assembly process. For example, the center contact 110 may be loaded into the dielectric insert 112 prior to the dielectric insert 112 being loaded into the plug housing 118. Alternatively, the center contact 110 may be loaded into the dielectric insert 112 after the plug housing 118 and rear housing 116 are coupled together. The center contact 110 may be loaded into the dielectric insert 112 either prior to or after the crimp barrel 126 is loaded onto the crimp end 188. The center contact 110 may be loaded into the dielectric insert 112 either prior to or after the center contact 110 is terminated to the center conductor of the coaxial cable 102.

Figure 4:
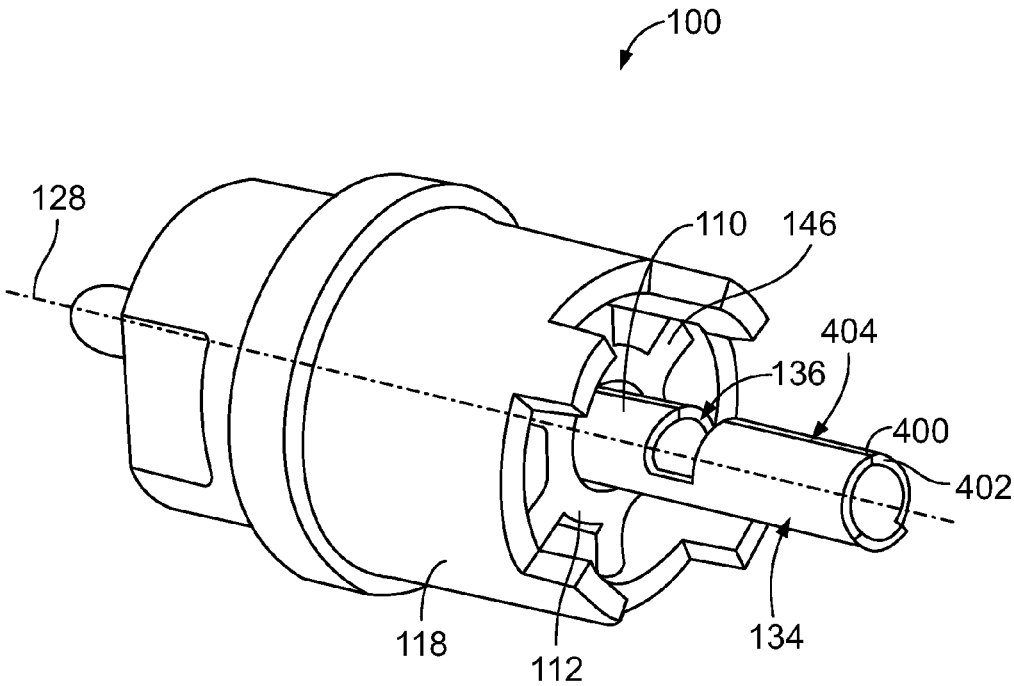
FIG. 4 is a rear perspective view of a portion of the plug connector shown in FIG. 2.

FIG. 4 is a rear perspective view of a portion of the plug connector 100 showing the center contact 110, dielectric insert 112 and plug housing 118. The center contact 110 is illustrated loaded into the dielectric insert 112. The dielectric insert 112 is illustrated loaded into the plug housing 118.

The structural features 146 engage the plug housing 118 to hold the axial position of the dielectric insert 112 and center contact 110. The structural features 146 engage the plug housing 118 to hold the angular position of the dielectric insert 112 with respect to the plug housing 118. The interference between the structural features 146 and the plug housing 118 resists rotation or torque of the dielectric insert 112 and center contact 110 during mating with the jack connector 200.

The barrel 134 is exposed rearward of the plug housing 118. In an exemplary embodiment, the center contact 110 is stamped and formed from a flat stock piece of metal that is bent or rolled into a tubular shape. The center contact 110 includes a first edge 400 and a second edge 402 that are the shear edges formed from the stamping process. The center contact 110 is formed by rolling the first and second edges 400, 402 toward one another until the first and second edges 400, 402 meet along a seam 404. At the barrel 134, the center contact 110 may be crimped to the center conductor by crimping the first and second edges 400, 402 inward onto the center conductor. In an exemplary embodiment, the crimp may be an F-crimp.

The opening 136 is positioned forward of the barrel 134. When the barrel 134 is crimped, the only portion of the center contact 110 that is affected is the barrel 134. The opening 136 stops the crimp effect forward of the opening 136. The portion of the center contact 110 forward of the opening 136 maintains a cylindrical shape and thus maintains a uniform spacing between the center contact 110 and the plug housing 118, which helps to maintain a uniform impedance along the longitudinal axis 128.

Figure 5:
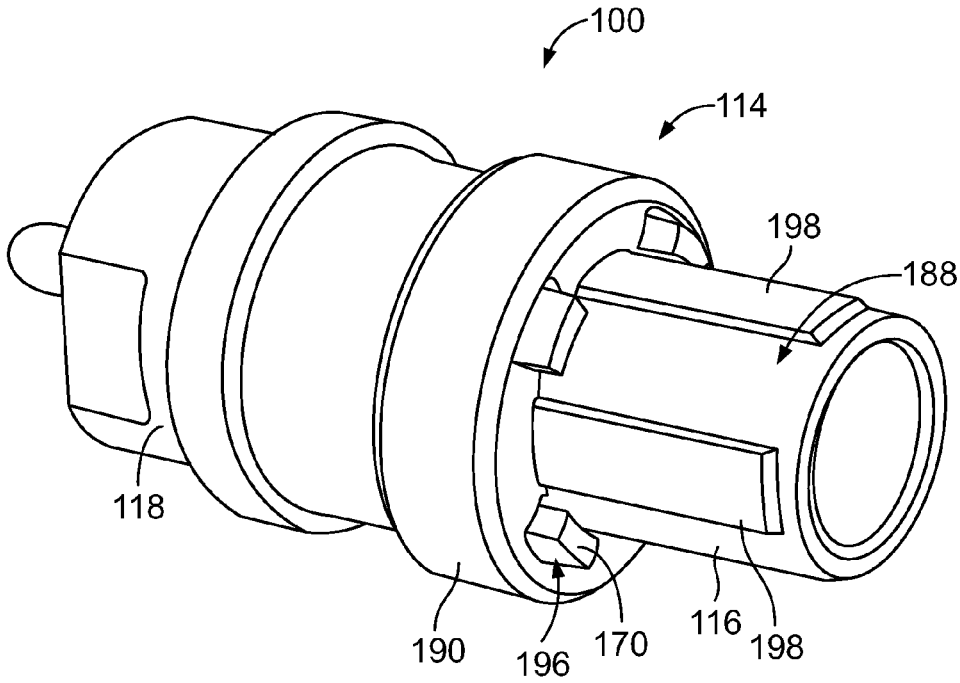
FIG. 5 is a rear perspective view of a portion of the plug connector shown in FIG. 2.

FIG. 5 is a rear perspective view of a portion of the plug connector 100 showing the outer contact 114. The plug housing 118 is coupled to the rear housing 116. The posts 170 extend through the openings 196 and are positioned rearward of the rim 190. The posts 170 may be staked to the rear housing 116, such as by applying pressure and/or heat to deform the posts 170 to lock the plug housing 118 onto the rear housing 116.

Both the plug housing 118 and the rear housing 116 are manufactured from a metal material. The plug housing 118 is electrically coupled to the rear housing 116 by the physical touching or interface between the plug housing 118 and the rear housing 116. In an exemplary embodiment, four posts 170 and corresponding openings 196 are provided and spaced circumferentially equidistant from one another. In the illustrated embodiment, the posts 170 are located in the gaps between the crush ribs 198. Four crush ribs 198 are provided and spaced equidistant around the crimp end 188.

Figure 6:
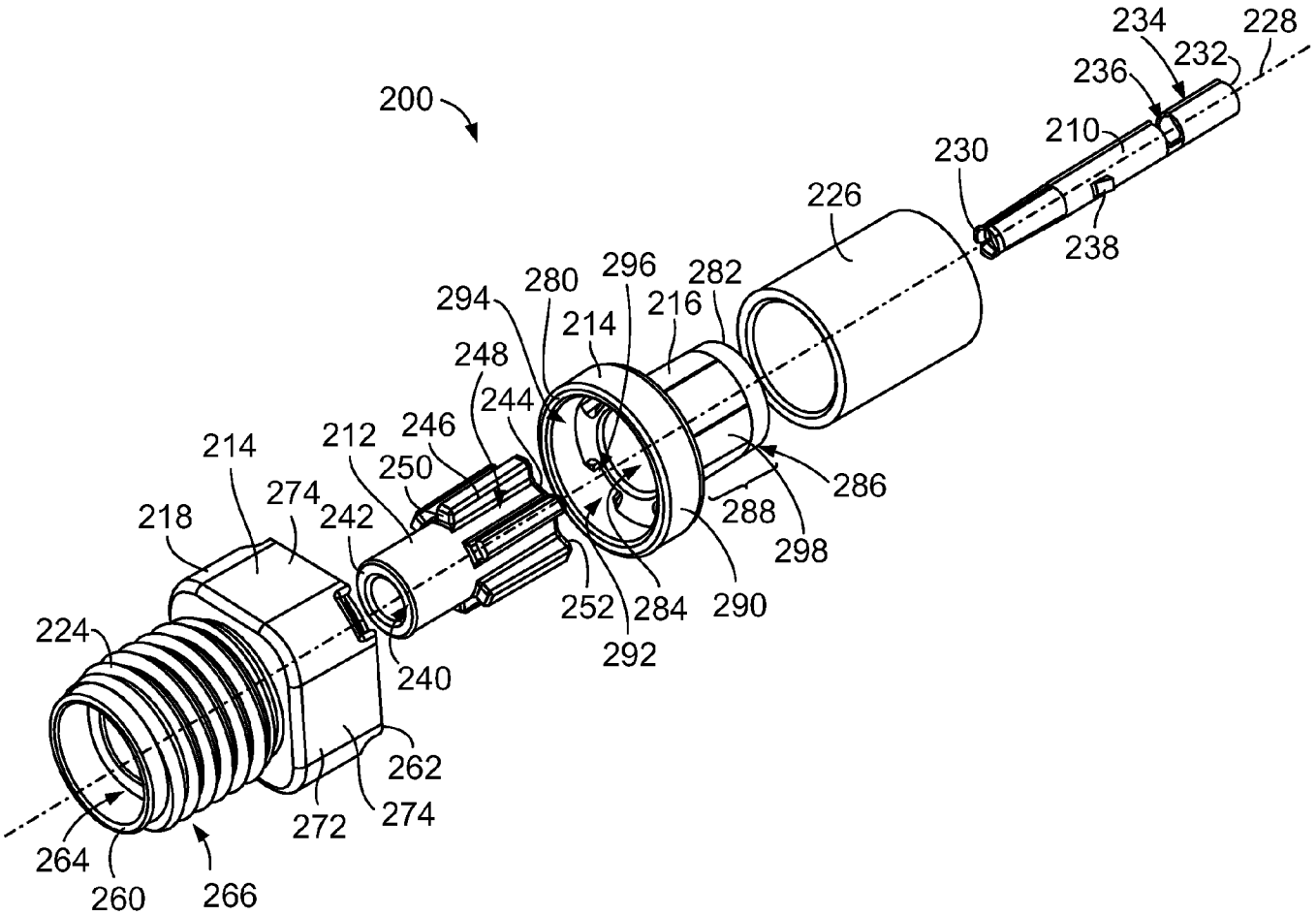
FIG. 6 is an exploded view of a jack connector of the coaxial connector system shown in FIG. 1.

FIG. 6 is an exploded view of the jack connector 200. The jack connector 200 includes a center contact 210, a dielectric insert 212 that holds the center contact 210, and an outer contact 214 that receives the dielectric insert 212 and the center contact 210. In an exemplary embodiment, the dielectric insert 212 may be identical to the dielectric insert 112 (shown in FIG. 2). As such, the product family (both plug and jack connectors 100, 200) does not need to include different types of dielectric inserts for the plug and jack connectors 100, 200, thereby reducing the overall number parts for the product family and reducing the overall cost of the platform.

The center contact 210 is configured to be terminated to a center conductor (not shown) of the coaxial cable 202 (shown in FIG. 1). The outer contact 214 is configured to be electrically connected to an outer conductor or cable shield (not shown) of the coaxial cable 202, such as by crimping or soldering to the cable shield.

In an exemplary embodiment, the outer contact 214 is a two-piece body formed from a rear housing 216 and a front housing 218. In an exemplary embodiment, the rear housing 216 may be identical to the rear housing 116 (shown in FIG. 2). As such, the product family (both plug and jack connectors 100, 200) does not need to include different types of rear housings for the plug and jack connectors 100, 200, thereby reducing the overall number parts for the product family and reducing the overall cost of the platform.

In the illustrated embodiment, the front housing 218 defines a jack housing and may be referred to hereinafter as the jack housing 218. The jack housing 218 has external threads 224 for securing the jack connector 200 to the plug connector 100. Optionally, the jack housing 218 may be a panel mount component and include features to secure the jack housing 218 to a panel or other structural component. For example, the jack housing 218 may include external threads, latches, or other features to secure the jack housing 218 in an opening through the panel.

The jack connector 200 includes a crimp barrel 226 coupled to the rear housing 216. In an exemplary embodiment, the crimp barrel 226 may be identical to the crimp barrel 126 (shown in FIG. 2). As such, the product family (both plug and jack connectors 100, 200) does not need to include different types of crimp barrels for the plug and jack connectors 100, 200, thereby reducing the overall number parts for the product family and reducing the overall cost of the platform. The crimp barrel 226 is used to crimp the jack connector 200 to the coaxial cable 202. The crimp barrel 226 is used to mechanically and electrically connect the jack connector 200 to the coaxial cable 202.

The center contact 210 extends along a longitudinal axis 228 of the jack connector 200 between a separable interface end 230 and a non-separable terminating end 232. The separable interface end 230 is configured to be mated with the separable interface end 130 (shown in FIG. 2) of the center contact 110 (shown in FIG. 2) of the plug connector 100 when the jack connector 200 is coupled thereto. In the illustrated embodiment, the separable interface end 230 defines a socket, however the center contact 210 may have a different mating interface in an alternative embodiment, such as a pin, such as to define a reverse polarity connector. In an exemplary embodiment, the center contact 210 is a stamped and formed contact. Stamped and formed contacts are less expensive to manufacture than machined contacts.

The terminating end 232 is configured to be terminated to a center conductor of the coaxial cable 202. In an exemplary embodiment, the center contact 210 has a barrel 234 at the terminating end 232. The barrel 234 is configured to receive the center conductor of the coaxial cable 202 therein. In an exemplary embodiment, the center contact 210 may be terminated to the center conductor of the coaxial cable 202 in multiple ways. For example, the terminating end 232 may be crimped to the center conductor in a first termination application and may be soldered to the center conductor in a second termination application.

In an exemplary embodiment, the center contact 210 includes an opening 236 forward of the barrel 234. The opening 236 stops the crimp effect of the barrel 234 forward of the opening 236 leaving the remaining portion of the center contact 210 forward of the opening 236 unaffected by the crimping process. The opening 236 defines an orientation feature of the center contact 210 that allows the center contact 210 to be held at a particular orientation with respect to a machine used to assembly the jack connector 200. In an exemplary embodiment, the opening 236 aligns an F-crimp tool with the center contact 210 to ensure that the F-crimp tool approaches directly where the seam is located to properly crimp the center contact 210 and/or compress the center conductor of the coaxial cable 202. The opening 236 stops propagation of solder into the center contact 210 forward of the opening 236.

The center contact 210 includes locking tabs 238 extending therefrom. The locking tabs 238 are deflectable. The locking tabs 238 are used to secure the center contact 210 in the dielectric insert 212.

The dielectric insert 212 has a bore 240 extending therethrough that receives and holds the center contact 210. The dielectric insert 212 extends between a front 242 and a rear 244. The bore 240 extends entirely through the dielectric insert 212 between the front 242 and the rear 244. The bore 240 extends axially along the longitudinal axis 228 of the jack connector 200.

The dielectric insert 212 is generally tubular in shape and includes a plurality of structural features 246 extending radially outward from an exterior of the tubular dielectric insert 212. Air gaps 248 are defined between the structural features 246. The structural features 246 are used to secure the dielectric insert 212 within the outer contact 214. In an exemplary embodiment, the dielectric insert 212 is received within the jack housing 218 and the structural features 246 engage the jack housing 218 to secure the dielectric insert 212 in the jack housing 218. The structural features 246 may engage the outer contact 214 and the hold the dielectric insert 212 by an interference fit therein. In an exemplary embodiment, the structural features 246 are tapered from a front 250 to a rear 252 of the structural features 246. In an exemplary embodiment, the size and shape of the structural features 246 are selected to provide a desired dielectric constant of the dielectric between the center contact 210 and the outer contact 214.

The jack housing 218 extends between a front 260 and a rear 262. The jack housing 218 has a central cavity 264 extending between the front 260 and the rear 262. The central cavity 264 receives the dielectric insert 212 and center contact 210. In an exemplary embodiment, the front 260 of the jack housing 218 defines a separable interface end 266 of the outer contact 214. The rear 262 of the jack housing 218 is configured to be coupled to the rear housing 216.

The jack housing 218 includes a shroud 272 at the rear 262 thereof. The shroud 272 is generally box-shaped and defines an outer perimeter of the jack housing 218. The external threads 224 extend forward of the shroud 272. The shroud 272 surrounds a barrel 268 (shown in FIG. 7) at the rear 262. A plurality of posts 270 (shown in FIG. 7) extend rearward from the barrel 268. In an exemplary embodiment, the barrel 268 and posts 270 may have an identical size and shape as the barrel 168 and posts 170 (both shown in FIG. 2). Having the barrel 268 and posts 270 the same as the barrel 168 and posts 170 allows the rear housing 216 to be identical to the rear housing 116 for platforming the product family.

The jack housing 218 includes flat surfaces 274 on an exterior of the shroud 272. The flat surfaces 274 are configured to angularly orient the jack housing 218 with respect to the rear housing 216 during coupling of the jack housing 218 to the rear housing 216. The flat surfaces 274 may be engaged by a machine used to assemble the jack connector 200 to hold the angular position of the jack housing 218 for loading the jack housing 218 onto the rear housing 216. Other features may be provided in alternative embodiments that allow the jack housing 218 to be oriented with respect to the assembly machine for assembly of the jack connector 200.

The rear housing 216 is configured to be interchangeably coupled to either the jack housing 218, as in the illustrated embodiment, the plug housing 118 (shown in FIG. 2) or any other cable variant (e.g., bulkhead connector housing, right angle connector housing, and the like) because the rear housing 216 includes features that allow the jack housing 218 or the plug housing 118 to be coupled thereto. Additionally, the jack housing 218 and the plug housing 118 include similar features for mounting to the rear housing 216 such that the rear housing 216 may be used with either the jack housing 218 or the plug housing 118.

The rear housing 216 includes a front 280 and a rear 282. A central cavity 284 extends through the rear housing 216 between the front 280 and the rear 282. The rear 282 of the rear housing 216 defines a terminating end 286 of the outer contact 214. The rear housing 216 includes a tubular crimp end 288 proximate to the rear 282.

The rear housing 216 includes a rim 290 proximate to the front 280. The rim 290 extends forward from the crimp end 288. The rim 290 defines a chamber 292 that receives a portion of the jack housing 218. The rim 290 and chamber 292 define a housing interface 294 at the front 280 of the rear housing 216. The jack housing 218 is coupled to the housing interface 294.

In an exemplary embodiment, the rear housing 216 includes a plurality of openings 296 at a rear or bottom of the chamber 292. When the jack housing 218 is coupled to the rear housing 216, the barrel 268 of the jack housing 218 is received in the chamber 292 and the posts 270 of the jack housing 218 extend through corresponding openings 296 in the rear housing 216. The posts 270 extend entirely through the openings 296 and may be staked from behind the rim 290 to secure the jack housing 218 to the rear housing 216.

In an exemplary embodiment, the rear housing 216 includes a plurality of crush ribs 298 extending axially along an exterior of the crimp end 288. The crimp barrel 226 is configured to be plugged onto the crimp end 288 and held on the crimp end 288 by an interference fit with the crush ribs 298. The crimp barrel 226 is electrically and mechanically coupled to the crimp end 288 via the crush ribs 298. The crimp barrel 226 may be secured to the crimp end 288 by alternative means or processes in alternative embodiments.

Figure 7:
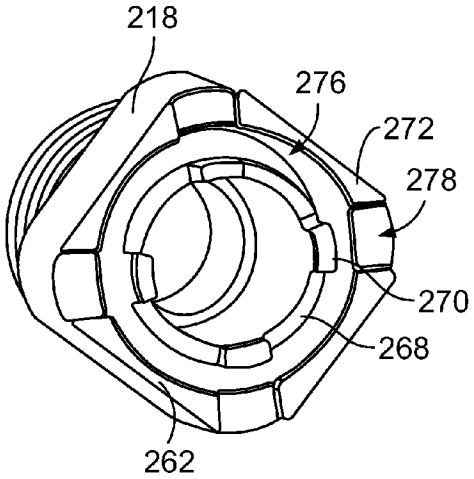
FIG. 7 is a rear perspective view of a portion of the jack connector shown in FIG. 6.

FIG. 7 is a rear perspective view of the jack housing 218. The shroud 272 surrounds the barrel 268 at the rear 262. The posts 270 extend rearward from the barrel 268. A circumferential groove 276 is positioned between the barrel 268 and the shroud 272. In an exemplary embodiment, channels 278 are provided at the rear 262 that extend between the groove 276 and the exterior of the shroud 272. In the illustrated embodiment, the channels 278 are provided at the corners of the shroud 272, however the channels 278 may be provided at other positions in alternative embodiments. Four channels 278 are provided, however any number of channels 278 may be provided in alternative embodiments. Optionally, the channels 278 may be located radially outward of the posts 270, however the channels 278 may be offset with respect to the posts 270 in alternative embodiments.

Figure 8:
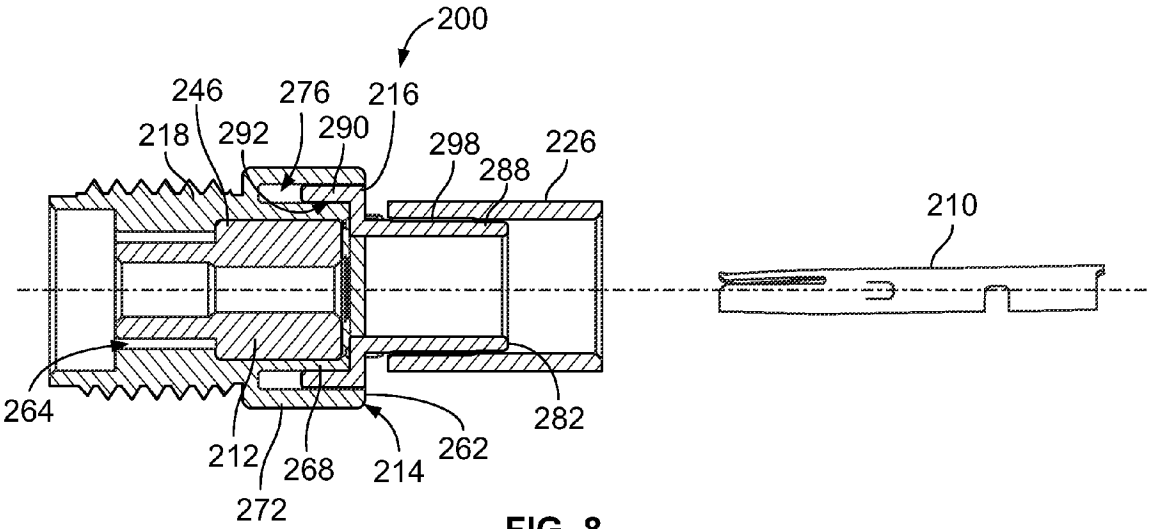
FIG. 8 is a cross-sectional view of the jack connector shown in FIG. 6.

FIG. 8 is a cross-sectional view of the jack connector 200 showing the center contact 210 poised for loading into the dielectric insert 212 and outer contact 214. During assembly, the dielectric insert 212 is inserted into the jack housing 218 through the rear 262. The structural features 246 engage the jack housing 218 to hold the dielectric insert 212 in the central cavity 264 by an interference fit. The rear 262 of the jack housing 218 is received in the chamber 292. The rim 290 circumferentially surrounds the rear 262 of the jack housing 218. The rim 290 is captured in the groove 276 defined between the shroud 272 and the barrel 268.

The crimp barrel 226 is loaded onto the rear 282 of the rear housing 216 over the crimp end 288. The crush ribs 298 engage the crimp barrel 226 to hold the crimp barrel 226 on the crimp end 288. A portion of the crimp barrel 226 extends rearward from the crimp end 288 and is configured to be crimped to the coaxial cable 202 (shown in FIG. 2).

Figure 9:
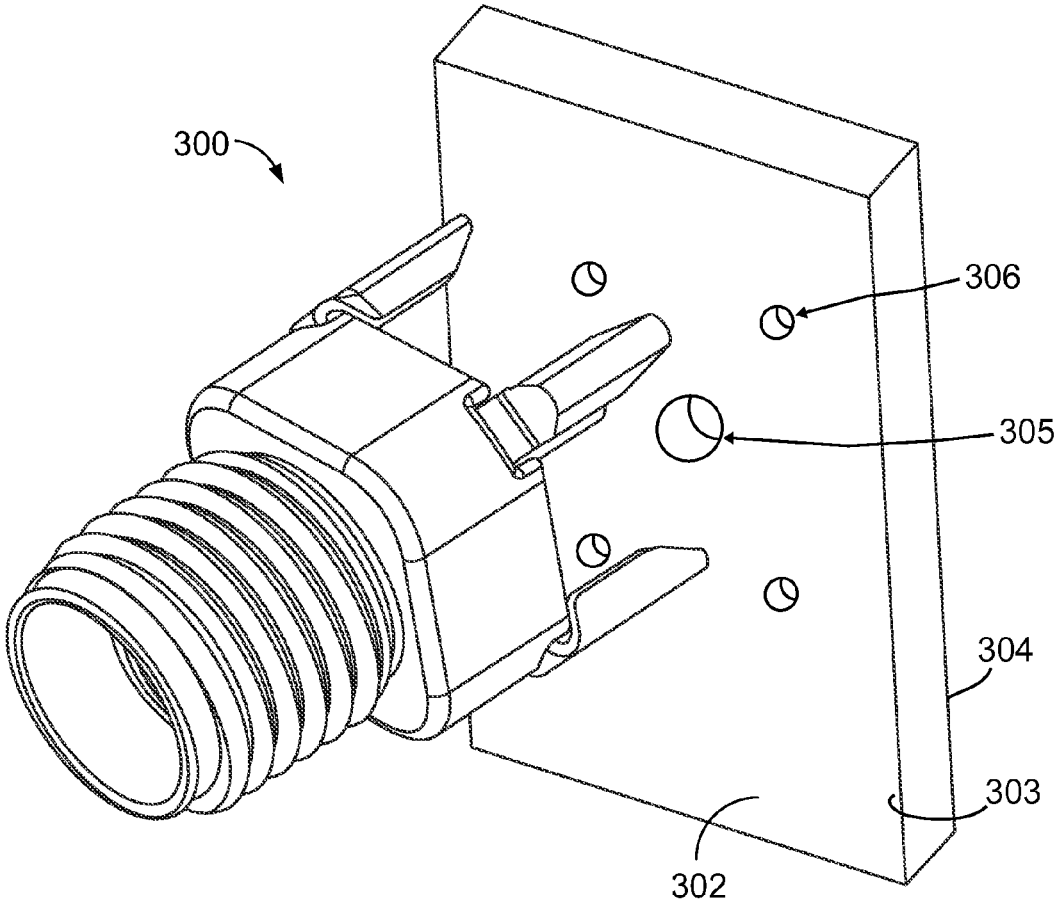
FIG. 9 is a front perspective view of a jack connector formed in accordance with an exemplary embodiment.

FIG. 9 is a front perspective view of a jack connector 300 formed in accordance with an exemplary embodiment. The jack connector 300 is configured to be mounted to a printed circuit board (PCB) 302. The jack connector 300 is configured to be electrically coupled with the plug connector 100 (shown in FIG. 1). The jack connector 300 includes an identical mating interface as the jack connector 200 (shown in FIG. 1). The jack connector 300 may include similar components as the jack connector 200, such as the jack housing 218, dielectric insert 212 and center contact 210 (all shown in FIG. 6).

The PCB 302 includes first and second surfaces 303, 304. A signal via 305 extends through the PCB 302 between the first and second surfaces 303, 304. The signal via 305 may be plated and electrically connected to a signal trace of the PCB 302 to define a signal conductor of the PCB 302. The signal via 305 is configured to be electrically connected to a center contact 310 (shown in FIG. 10) of the jack connector 300.

The PCB 302 includes ground vias 306 extending through the PCB 302 between the first and second surfaces 303, 304. The ground vias 306 surround the signal via 305. The ground vias 306 may be plated and electrically connected to one or more ground planes of the PCB 302 to define ground conductors of the PCB 302. The ground via 306 is configured to be electrically connected to a circuit board mount 316 (shown in FIG. 10) of the jack connector 300.

In an exemplary embodiment, the center contact 310 and circuit board mount 316 are through-hole mounted to the PCB 302 by plugging the center contact 310 and circuit board mount 316 into the signal via 305 and ground vias 306, respectively. The jack connector 300 may be terminated to the PCB 302 by alternative means, such as by surface mounting the center contact 310 and/or circuit board mount 316 to the PCB 302.

Figure 10:
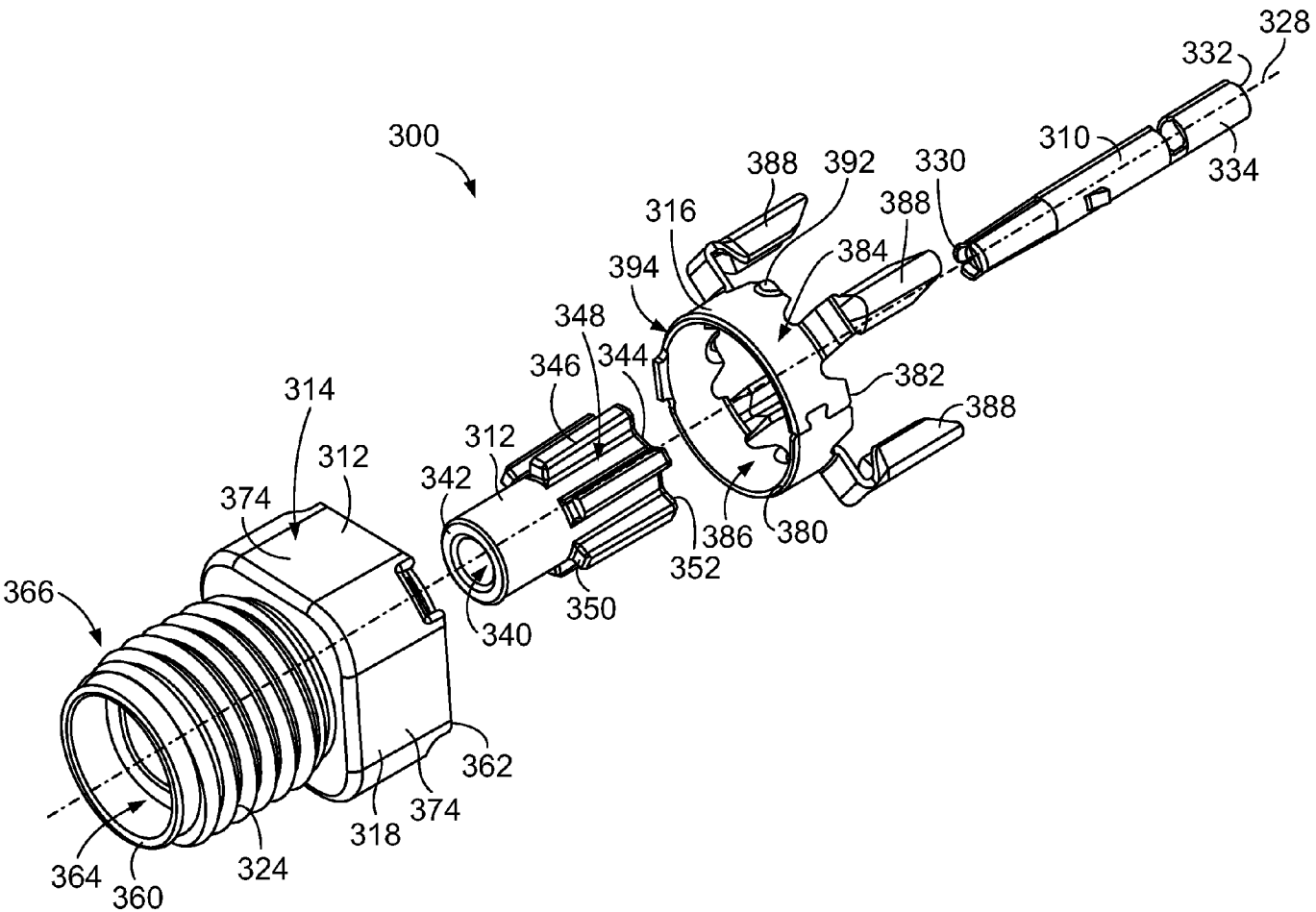
FIG. 10 is an exploded view of the jack connector shown in FIG. 9.

FIG. 10 is an exploded view of the jack connector 300. The jack connector includes a center contact 310, a dielectric insert 312 that holds the center contact 310, an outer contact 314 that receives the dielectric insert 312 and the center contact 310, and a circuit board mount 316 coupled to the outer contact 314 and used to mount the jack connector 300 to the PCB 302 (shown in FIG. 9). In an exemplary embodiment, the dielectric insert 312 may be identical to the dielectric inserts 112, 212 (shown in FIGS. 2 and 6). As such, the product family (plug and jack connectors 100, 200, 300) does not need to include different types of dielectric inserts for the plug and jack connectors 100, 200, 300, thereby reducing the overall number parts for the product family and reducing the overall cost of the platform.

The center contact 310 is configured to be terminated to the PCB 302 (shown in FIG. 9), such as to a signal conductor of the PCB 302. The outer contact 314 is configured to be electrically connected to the PCB 302, such as to a ground conductor of the PCB 302.

In an exemplary embodiment, the outer contact 314 is a one-piece body formed from a jack housing 318. The outer contact 314 does not include a rear housing such as was used to connect the jack connector 200 to a coaxial cable. The jack housing 318 has external threads 324 for securing the jack connector 300 to the plug connector 100.

In an exemplary embodiment, the center contact 310 may be identical to the center contact 210 (shown in FIG. 6). As such, the product family (the jack connectors 200, 300) does not need to include different types of center contacts, thereby reducing the overall number parts for the product family and reducing the overall cost of the platform. The center contact 310 is configured to be terminated to both a center conductor of a cable (for use with the jack connector 200) and a plated via in the PCB 302 (for use with the jack connector 300).

The center contact 310 extends along a longitudinal axis 328 of the jack connector 300 between a separable interface end 330 and a non-separable terminating end 332. The separable interface end 330 is configured to be mated with the separable interface end 130 (shown in FIG. 2) of the center contact 110 (shown in FIG. 2) of the plug connector 100 when the jack connector 300 is coupled thereto.

The terminating end 332 is configured to be terminated to the PCB 302. In an exemplary embodiment, the center contact 310 has a barrel 334 at the terminating end 332. The barrel 334 is configured to be received in the plated signal via 305 (shown in FIG. 9) of the PCB 302 to electrically connect the center contact 310 to the PCB 302. Optionally, the barrel 334 may be soldered to the PCB 302. The barrel 334 may be compressed when loaded into the via such that the barrel 334 is biased against the via and may be held by an interference fit in the via. Through-hole mounting to the PCB 302 defines another termination application of the center contact 310, in addition to the soldering and crimping described with reference to the jack connector 200.

The dielectric insert 312 has a bore 340 extending therethrough that receives and holds the center contact 310. The dielectric insert 312 extends between a front 342 and a rear 344. The bore 340 extends entirely through the dielectric insert 312 between the front 342 and the rear 344. The bore 340 extends axially along the longitudinal axis 328 of the jack connector 300.

The dielectric insert 312 is generally tubular in shape and includes a plurality of structural features 346 extending radially outward from an exterior of the tubular dielectric insert 312. Air gaps 348 are defined between the structural features 346. The structural features 346 are used to secure the dielectric insert 312 within the jack housing 318 by an interference fit therein. In an exemplary embodiment, the structural features 346 are tapered from a front 350 to a rear 352 of the structural features 346. In an exemplary embodiment, the size and shape of the structural features 346 are selected to provide a desired dielectric constant of the dielectric between the center contact 310 and the outer contact 314.

The jack housing 318 is configured to be interchangeably coupled to either the circuit board mount 316, as in the illustrated embodiment, or the rear housing 216 (shown in FIG. 6) because the jack housing 318 includes features that allow both the circuit board mount 316 or the rear housing 216 to be coupled thereto. The jack housing 318 extends between a front 360 and a rear 362. The jack housing 318 has a central cavity 364 extending between the front 360 and the rear 362. The central cavity 364 receives the dielectric insert 312 and center contact 310. In an exemplary embodiment, the front 360 of the jack housing 318 defines a separable interface end 366 of the outer contact 314. The rear 362 of the jack housing 318 defines a terminating end of the outer contact 314.

The jack housing 318 includes a shroud 372 at the rear 362 thereof. The shroud 372 is generally box-shaped and defines an outer perimeter of the jack housing 318. The external threads 324 extend forward of the shroud 372. The shroud 372 surrounds a barrel 368 (shown in FIG. 11) at the rear 362. A plurality of posts 370 (shown in FIG. 11) extend rearward from the barrel 368. In an exemplary embodiment, the barrel 368 and posts 370 may have an identical size and shape as the barrel 268 and posts 270 (both shown in FIG. 7). Having the barrel 368 and posts 370 the same as the barrel 268 and posts 270 allows the circuit board mount 316 and the rear housing 216 to have similar shapes and/or sizes for platforming the product family.

The jack housing 318 includes flat surfaces 374 on an exterior of the shroud 372. The flat surfaces 374 are configured to angularly orient the jack housing 318 with respect to the circuit board mount 316 during coupling of the circuit board mount 316 to the jack housing 318. The flat surfaces 374 may be engaged by a machine used to assemble the jack connector 300 to hold the angular position of the jack housing 318. Other features may be provided in alternative embodiments that allow the jack housing 318 to be oriented with respect to the assembly machine for assembly of the jack connector 300.

The circuit board mount 316 is configured to mechanically and electrically connect the outer contact 314, which in the illustrated embodiment is the jack housing 318, to the PCB 302. The circuit board mount 316 includes a front 380 and a rear 382. A cylindrical rim 384 surrounds a central cavity 386 extending between the front 380 and the rear 382. Mounting legs 388 extend from the rear 382 of the rim 384. The mounting legs 388 are terminated to the PCB 302 to secure the circuit board mount 316 to the PCB 302. The mounting legs 388 may be received in the plated ground vias 306 (shown in FIG. 9) in the PCB 302 to mechanically and electrically connect the circuit board mount 316 to the PCB 302. The mounting legs 388 may be press fit into the vias in the PCB 302 to mechanically and/or electrically connect the circuit board mount 316 to the PCB 302.

The rim 384 includes dimples 392 at the rear 382. The dimples 392 are used to secure the circuit board mount 316 in the jack housing 318. The dimples 392 engage the outer contact 314 to hold the rim 384 in the outer contact 314. The rim 384 defines a housing interface 394 at the front 380 of the circuit board mount 316. The jack housing 318 is coupled to the housing interface 394.

Figure 11:
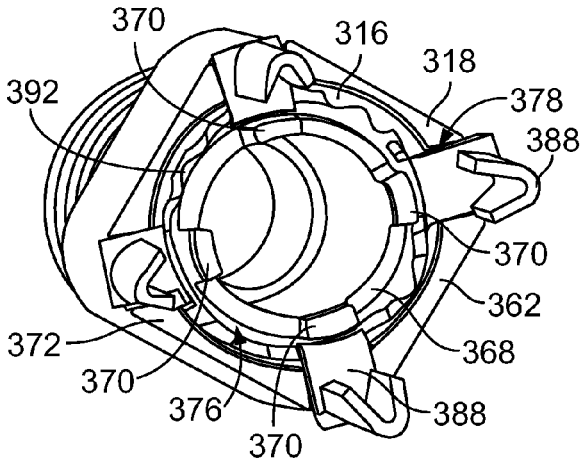
FIG. 11 is a rear perspective view of a portion of the jack connector shown in FIG. 9.

FIG. 11 is a rear perspective view of the jack housing 318 showing the circuit board mount 316 coupled to the jack housing 318. The shroud 372 surrounds the barrel 368 at the rear 362. The posts 370 extend rearward from the barrel 368. A circumferential groove 376 is positioned between the barrel 368 and the shroud 372.

In an exemplary embodiment, channels 378 are provided at the rear 362 that extend between the groove 376 and the exterior of the shroud 372. In the illustrated embodiment, the channels 378 are provided at the corners of the shroud 372, however the channels 378 may be provided at other positions in alternative embodiments. Four channels 378 are provided, however any number of channels 378 may be provided in alternative embodiments. Optionally, the channels 378 may be located radially outward of the posts 370, however the channels 378 may be offset with respect to the posts 370 in alternative embodiments.

The mounting legs 388 extend into corresponding channels 378. The mounting legs 388 are secured in the channels 378. In an exemplary embodiment, the shroud 372, at the edges of the channels 378, may be staked to the mounting legs 388 to secure the mounting legs 388 in the channels 378. Other means or processes may be used to mechanically and electrically couple the circuit board mount 316 to the jack housing 318.

The dimples 392 are used to secure the circuit board mount 316 in the jack housing 318. The dimples 392 are received in the groove 376 and are held in the groove 376 by an interference fit. Any number of dimples 392 may be provided.

Figure 12:
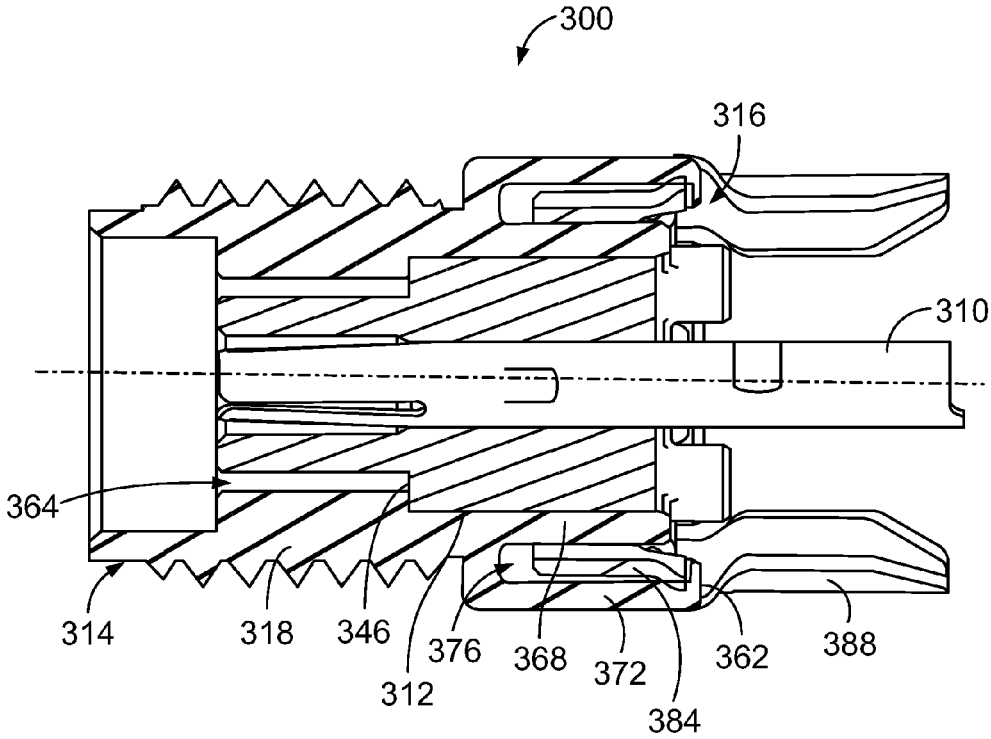
FIG. 12 is a cross-sectional view of the jack connector shown in FIG. 9.

FIG. 12 is a cross-sectional view of the jack connector 300 showing the center contact 310 loaded in the dielectric insert 312 and outer contact 314. During assembly, the dielectric insert 312 is inserted into the jack housing 318 through the rear 362. The structural features 346 engage the jack housing 318 to hold the dielectric insert 312 in the central cavity 364 by an interference fit. The circuit board mount 316 is coupled to the jack housing 318 by loading the rim 384 in the groove 376 between the shroud 372 and the barrel 368. The center contact 310 and the mounting legs 388 extend rearward from the jack housing 318 and are configured to be mounted to the PCB 302 (shown in FIG. 9).

In an exemplary embodiment, the plug and jack coaxial connectors 100, 200 include common components for platforming the product line. A dielectric insert 112, 212 and a rear housing 116, 216 are identical. The front housings 118, 218 are different to define the plug and jack interfaces, but include common features for coupling to the rear housings 116, 216 and receiving the inserts 112, 212. The dielectric 112, 212 includes the structural features 146, such as wings or tabs, with air gaps 148 therebetween that are designed to control impedance. The center contact 110, 210 may be configured to be terminated by a plurality of different termination techniques in different applications, such as either crimping, soldering or board mounting. The overall cost of the product family is reduced by utilizing common components across both types of connectors. The impedance is controlled by the dielectric 112, 212. The dielectric is molded, rather than being machined, which is a less expensive manufacturing process.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial connector comprising:

a center contact;

an outer contact having a central cavity, the center contact being disposed in the central cavity, the outer contact having a separable interface end configured to be mated to a mating connector, the outer contact having a terminating end, the cavity extending between the separable interface end and the terminating end; and a dielectric insert received in the central cavity, the dielectric insert having a bore that receives and holds the center contact, the dielectric insert having structural features extending axially along an exterior of the dielectric insert, the structural features extending to distal ends, the distal ends being tapered from a front to a rear thereof to increase a diameter of the dielectric insert at a rear of the dielectric insert, air gaps being defined between the structural features, the distal ends of the structural features engaging the outer contact to secure the dielectric insert in the central cavity, wherein the outer contact includes a rear housing defining the terminating end, the rear housing having a housing interface at a front of the rear housing, the rear housing being interchangeably coupled to either a plug housing or a jack housing at the housing interface, wherein when the plug housing is coupled to the rear housing, the outer contact includes a coupling nut rotatably coupled to the plug housing with internal threads for coupling the outer contact to a jack connector defining the mating connector, and when the jack housing is coupled to the rear housing, the outer contact includes external threads for coupling the outer contact to a plug connector defining the mating connector.

2. The coaxial connector of claim 1, wherein the size and shape of the structural features are selected to proyide a desired dielectric constant of dielectric between the center contact and the outer contact to control the impedance of the coaxial connector.

3. The coaxial connector of claim 1, wherein the dielectric insert engages the outer contact and the structural features hold the dielectric insert by an interference fit in the central cavity.

4. The coaxial connector of claim 1, wherein the structural features engage the outer contact to resist rotation of the dielectric insert within the central cavity.

5. A coaxial connector comprising:

a center contact having a separable interface end and a terminating end, the center contact having a barrel at the terminating end of the center contact, wherein, in a first termination application, the terminating end of the center contact is configured to receive a center conductor of a coaxial cable in the barrel and be crimped to the center conductor, and in a second termination application, the terminating end of the center contact is configured to receive a center conductor in the barrel and be soldered to the center conductor;

an outer contact having a central cavity, the center contact being disposed in the central cavity, the outer contact having a separable interface end configured to be mated to a mating connector, the outer contact having a terminating end, the cavity extending between the separable interface end and the terminating end; and a dielectric insert received in the central cavity, the dielectric insert having a bore that receives and holds the center contact, the dielectric insert having structural features extending axially along an exterior of the dielectric insert, air gaps being defined between the structural features, the structural features engaging the outer contact to secure the dielectric insert in the central cavity.

6. The coaxial connector of claim 5, wherein in a third termination application, the terminating end of the center contact is configured to be received in a printed circuit board and be electrically and mechanically coupled to the printed circuit board.

7. The coaxial connector of claim 5, wherein the center contact is stamped and formed.

8. The coaxial connector of claim 5, wherein the center contact includes a first edge and a second edge meeting at a seam extending axially along the center contact, the first and second edges being crimped inward at the terminating end in the first application to crimp to the center conductor of the coaxial cable.

9. The coaxial connector of claim 5, wherein the center contact includes an opening forward of the barrel, the opening stopping the crimp effect of the barrel forward of the opening.

10. The coaxial connector of claim 5, wherein the outer contact includes a rear housing defining the terminating end, the rear housing having a housing interface at a front of the rear housing, the rear housing being interchangeably coupled to either a plug housing or a jack housing at the housing interface, wherein when the plug housing is coupled to the rear housing, the outer contact includes a coupling nut rotatably coupled to the plug housing with internal threads for coupling the outer contact to a jack connector defining the mating connector, and when the jack housing is coupled to the rear housing, the outer contact includes external threads for coupling the outer contact to a plug connector defining the mating connector.

11. The coaxial connector of claim 5, wherein the structural features are tapered from a front to a rear of the structural features to increase a diameter of the dielectric insert at a rear of the dielectric insert.

12. The coaxial connector of claim 5, wherein the dielectric insert engages the outer contact and the structural features hold the dielectric insert by an interference fit in the central cavity.

13. A coaxial connector comprising:

a center contact;

a dielectric insert having a bore that receives and holds the center contact; and an outer contact having a central cavity that receives the dielectric insert and the center contact, the outer contact having a separable interface end configured to be mated to a mating connector, the outer contact having a terminating end configured to be terminated to a coaxial cable;

wherein the outer contact includes a rear housing defining the terminating end, the rear housing having a housing interface at a front of the rear housing;

and wherein the rear housing is interchangeably coupled to either a plug housing or a jack housing at the housing interface, wherein when the plug housing is coupled to the rear housing, the outer contact includes a coupling nut rotatably coupled to the plug housing with internal threads for coupling the outer contact to a jack connector defining the mating connector, and when the jack housing is coupled to the rear housing, the outer contact includes external threads for coupling the outer contact to a plug connector defining the mating connector.

14. The coaxial connector of claim 13, wherein the rear housing includes openings therethrough, the plug housing and jack housing both include posts extending therefrom, the openings of the rear housing being configured to receive either the posts of the plug housing or the posts of the jack housing, such posts being staked once received therein to secure the rear housing to the either the plug housing or the jack housing.

15. The coaxial connector of claim 13, wherein the plug housing and the jack housing both include flat surfaces on an exterior thereof, the flat surfaces being configured to angularly orient the plug housing or the jack housing with respect to the rear housing during coupling of the plug housing or the jack housing to the rear housing.

16. The coaxial connector of claim 13, wherein the rear housing includes a tubular crimp end, the coaxial connector further comprising a crimp barrel being plugged onto the crimp end and held on the crimp end by an interference fit, the crimp barrel configured to be terminated to the coaxial cable.

17. The coaxial connector of claim 13, wherein the plug housing includes a flange extending from an exterior of the plug housing, the coupling nut including a lip, the lip being captured between the flange and the rear housing to axially position the coupling nut with respect to the plug housing, the coupling nut being rotatable with respect to the plug housing.

18. The coaxial connector of claim 13, wherein the rear housing includes a tubular crimp end and a rim extending forward of the crimp end, the rim defining a chamber that receives the plug housing or the jack housing, the rim and chamber defining the housing interface.

19. The coaxial connector of claim 18; wherein the rear housing includes openings at a rear of the chamber, and wherein the plug housing includes a barrel and posts extending from the barrel, wherein when the plug housing is coupled to the rear housing, the barrel of the plug housing is received in the chamber and the posts of the plug housing extend through the openings in the rear housing, and wherein the jack housing includes a barrel and posts extending from the barrel of the jack housing, wherein when the jack housing is coupled to the rear housing, the barrel of the jack housing is received in the chamber and the posts of the jack housing extend through the openings in the rear housing.

* * * * *